US007762911B2

(12) United States Patent
Gobush et al.

(10) Patent No.: US 7,762,911 B2
(45) Date of Patent: Jul. 27, 2010

(54) METHOD FOR PREDICTING BALL LAUNCH CONDITIONS

(75) Inventors: William Gobush, North Dartmouth, MA (US); Laurent Bissonnette, Portsmouth, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/125,240

(22) Filed: May 22, 2008

(65) Prior Publication Data

US 2008/0220891 A1 Sep. 11, 2008

Related U.S. Application Data

(63) Continuation-in-part of application No. 11/211,537, filed on Aug. 26, 2005.

(51) Int. Cl.
*A63B 53/00* (2006.01)

(52) U.S. Cl. ..... 473/409

(58) Field of Classification Search ..... 473/409
See application file for complete search history.

(56) References Cited

U.S. PATENT DOCUMENTS 3,681,979 A * 8/1972 Hammond, Jr. ..... 73/81
4,136,387 A 1/1979 Sullivan et al.
5,471,383 A 11/1995 Gobush et al.
5,501,463 A 3/1996 Gobush et al.
6,454,664 B1 * 9/2002 Long et al. ..... 473/330
6,571,600 B2 6/2003 Bissonnette et al.
6,758,759 B2 7/2004 Gobush et al.
6,821,209 B2 11/2004 Manwaring et al.
7,166,035 B2 * 1/2007 Voges et al. ..... 473/222
2002/0173367 A1 11/2002 Gobush et al.
2006/0272389 A1 12/2006 Tsunoda
2007/0049393 A1 3/2007 Gobush

OTHER PUBLICATIONS

Gobush, W. "Impact Force Measurements on Golf Balls," pp. 219-224 in *Science and Golf*, published by E.F. Spoon, London, 1990.

Dr. Ralph Simon, titled "The Development of a Mathematical Tool for Evaluating Golf Club Performance," ASME Design Engineering Conference, New York, May 1967 (pp. 17-35).

Johnson, S.H. and Lieberman, B.B. titled "An Analytical Model for Ball-barrier impact", pp. 315-320, *Science and Golf II*, published by E.F. Spoon, London, 1994.

"Experimental Study of Golf Ball Oblique Impact" by S.H. Johnson and E. A. Ekstrom in Science and Golf III, pp. 519-525.

(Continued)

*Primary Examiner*—Stephen L. Blau
(74) *Attorney, Agent, or Firm*—Daniel W. Sullivan

(57) ABSTRACT

The present invention relates to a method and a numerical analysis for predicting golf ball launch conditions, e.g., velocity, launch angle and spin rate. By acquiring pre-impact swing conditions, e.g., club speed, rotational rate and ball hit location, along with pertinent club features, e.g., moment of inertia, and ball impact features, e.g., normal and transverse forces as well as time of contact, the method can predict the resulting trajectory and launch conditions of the golf ball. The predicted ball launch conditions and trajectories can also be used to modify one or more properties of the golf ball or golf club. The time of contact measurements can be corrected to account for drag force.

8 Claims, 5 Drawing Sheets

OTHER PUBLICATIONS

"Experimental Determination of Golf Ball Coefficients of Sliding Friction" by Johnson, S. H. and Ekstrom, E.A., pp. 510-518, *Science and Golf*, edited by Farally, M. R. and Cochran, A. J., published by Human Kinetics, 1999.

"Rigid Body Impact Models Partially Considering Deformation" by Polukoshko, S., Viba, J., Kononova. O. and Sokolova, S., published in the Proc. Estonian Acad. Sci. Eng., 2007, 13, 2, 140-155.

Nelder, J.A., and Mead, R. 1965,Computer Journal, vol. 7, pp. 308-313 "Experimental Determination of Apparent Contact Time in Normal Impact," by S.H. Johnson and B.B. Lieberman, pp. 524-530, in *Science and Golf IV* edited by Eric.

"Spin and the Inner Workings of a Golf Ball," by W. Gobush, 1995, in a book titled *Golf the Scientific Way*, edited by Cochran, A., Aston Publishing Group, Hertfordshire, (pp. 141-149).

Gobush, W. titled "Friction Coefficient of Golf Balls,"*the Engineering of Sport*, edited by Haake, Blackwell Science, Oxford (1996), (pp. 193-194).

Nelder, J.A., and Mead, R. 1965,Computer Journal, vol. 7, pp. 308-313 "Experimental Determination of Apparent Contact Time in Normal Impact," by S.H. Johnson and B.B. Lieberman, pp. 524-530, in *Science and Golf IV* edited by Eric Thain (2002).

* cited by examiner

Velocity measured (inches/sec)

METHOD FOR PREDICTING BALL LAUNCH CONDITIONS

CROSS-REFERENCE TO RELATED APPLICATIONS

This application is a continuation-in-part of U.S. patent application Ser. No. 11/211,537 filed on Aug. 26, 2005, and published as US 2007/0049393 A1, which is incorporated herein by reference in its entirety.

FIELD OF THE INVENTION

The present invention relates to a method and computer program for determining golf ball launch conditions. More specifically, the present invention relates to a method and computer program that is capable of predicting golf ball trajectory and launch conditions.

BACKGROUND OF THE INVENTION

Over the past thirty years, camera acquisition of a golfer's club movement and ball launch conditions have been patented and improved upon. An example of one of the earliest high speed imaging systems is U.S. Pat. No. 4,136,387, entitled "Golf Club Impact and Golf Ball Monitoring System," issued in 1979. This automatic imaging system employed six cameras to capture pre-impact conditions of the club and post impact launch conditions of a golf ball using retroreflective markers. In an attempt to make such a system portable for outside testing, patents such as U.S. Pat. Nos. 5,471,383 and 5,501,463 to Gobush disclosed a system of two cameras that could triangulate the location of retroreflective markers appended to a club or golf ball in motion.

These systems allowed the kinematics of the club and ball to be measured. Additionally, these systems allowed a user to compare their performance using a plurality of golf clubs and balls. Typically, these systems include one or more cameras that monitor the club, the ball, or both. By monitoring the kinematics of both the club and the ball, an accurate determination of the ball trajectory and kinematics can be determined.

A recent patent, U.S. Pat. No. 6,758,759, entitled "Launch Monitor System and a Method for Use Thereof," issued in 2004, describes a method of monitoring both golf clubs and balls in a single system. This resulted in an improved portable system that combined the features of the separate systems. The use of fluorescent markers in the measurement of golf equipment was added in U.S. published patent application. No. 2002/0173367 A1.

Monitoring both the club and the ball requires complicated imaging techniques. Additionally, complicated algorithms executed by powerful processors are required to accurately and precisely determine club and ball kinematics. Furthermore, these systems are typically unable to quickly determine which combination of club and balls produces the best outcome for a particular player. Presently, the only way to accomplish this was to test a golfer with a variety of different clubs and/or balls, and then monitor which combination resulted in the most desirable ball trajectory.

The need for a mathematical tool for evaluating golf club performance is dictated by the large number of club design parameters and initial conditions of the impact between club head and ball. Without such a tool, it is not feasible to make quantitative predictions of the effects of a design change on the ball motions and shaft stresses.

For example, in stereo mechanical impact, as described in U.S. Pat. No. 6,821,209 to Manwaring et al., the final velocities and spin rates can be related to the initial values of these quantities without considering the changes that occurred during impact between the club head and the ball, e.g., about 500 microseconds. However, by eliminating the details from the impact between the club and the ball, the stereo mechanical impact approach assumes that: (1) the three components of the relative velocity of recession of the ball from the club head can be related to those of the approach of the club to the ball, as measured at the impact point, by "coefficient of restitution" and; (2) the shaft can be considered completely flexible, like a stretched rubber band, as far as the dynamics of impact are concerned, so that no dynamic changes occur in the force or torque that it exerts on the club head during the impact.

The stereo mechanical approximation problem involves a set of 12 simultaneous linear algebraic equations in the 12 unknown components of motion of the ball and club after impact. The known quantities in these equations are the initial conditions, i.e., club head motions and impact point coordinates, and the many mechanical parameters of the club head and golf ball, e.g., masses, mass moments of inertia, centers of mass, face loft angle, and face radii of curvature. The explicit algebraic expressions are described in the '209 patent to Manwaring et al.

The stereo mechanical approximation has drawbacks, such as (1) the effects of the shaft on the impact, although small, are not negligible, and it is desirable to obtain quantitative measures of these effects for shaft design purposes; (2) shaft stresses cannot be computed in any realistic manner; (3) the explicit algebraic expressions obtained are still too complex to permit assessments to be made of the effects of design parameter changes except by working out many specific cases with the aid of a computer; and (4) the coefficient of restitution approximation may not be accurate because the sliding and sticking time of the ball at the impact point is not taken into account. In addition, the coefficient of restitution approximation is poor because different amounts of stress wave energy may be "trapped" in the shaft under different impact conditions.

Impact forces can also be measured. Measurements and instrumentation to measure normal and transverse forces on golf balls was described in Gobush, W. "Impact Force Measurements on Golf Balls," pp. 219-224 *in Science and Golf*, published by E. F. Spoon, London, 1990. Although the piezoelectric sensor instrument measured these forces and result in explanation of the nature of the normal and transverse force, the transducer noise was found to cause spurious signals that resulted in low accuracy estimates of spin rate and contact time. With newer methods to measure contact time and coefficient of restitution as described in U.S. Pat. No. 6,571,600 to Bissonnette et al. a renewed effort was implemented in estimating these forces from impacting golf balls with a steel block.

In an effort to improve the accurate modeling of the contact between the club and the ball, a model published by Dr. Ralph Simon, titled "The Development of a Mathematical Tool for Evaluating Golf Club Performance," ASME Design Engineering Conference, New York, May 1967 (pages 17-35) was improved and updated mathematically. In addition, the modeling may also be implemented by a golf ball model described in the paper titled "Spin and the Inner Workings of a Golf Ball," by W. Gobush, 1995, in a book titled *Golf the Scientific Way*, edited by Cochran, A., Aston Publishing Group, Hertfordshire. Both models were shown to give roughly equivalent results on studies of a golf ball hitting a steel block. These two references are incorporated herein by reference in their entireties.

Further modeling of transverse impact is described by Johnson, S. H. and Lieberman, B. B. titled "An Analytical Model for Ball-barrier impact", pp. 315-320, *Science and Golf II*, published by E. F. Spoon, London, 1994. A further experimental assessment of this model was presented in "Experimental Study of Golf Ball Oblique Impact" by S. H. Johnson and E. A. Ekstrom in Science and Golf III, pp. 519-525.

A method for measuring the coefficient of friction between golf ball and plate is described in Patent Application US2006/0272389 A1. This quantity is useful in modeling the collision process when sliding becomes predominant in the collision process. Experimental methods for measuring the coefficient of sliding friction are described in "Experimental Determination of Golf Ball Coefficients of Sliding Friction" by Johnson, S. H. and Ekstrom, E. A., pp. 510-518, *Science and Golf*, edited by Farally, M. R. and Cochran, A. J., published by Human Kinetics, 1999. Also, coefficient of friction measurements are discussed in a paper by Gobush, W. titled "Friction Coefficient of Golf Balls," *the Engineering of Sport*, edited by Haake, Blackwell Science, Oxford (1996).

Therefore, a continuing need exists for a system that is capable of determining or modeling the trajectory and launch conditions of a golf ball. Moreover, a continuing need exists for a system that includes software that reduces the complexity associated with fitting a golfer with golf equipment, and for a system that more accurately predicts a golfer's ball striking performance.

BRIEF SUMMARY OF THE INVENTION

The present invention relates to a method for predicting velocity, launch angle and spin rate of a golf ball following an impact with a golf club or a slug comprising the steps of (a) determining at least one pre-impact swing conditions;

(b) determining at least one property of the golf club;

(c) calculating a normal force of the impact in a normal direction;

(d) calculating a transverse force of the impact in a transverse direction; and (e) predicting the velocity, launch angle and spin rate from steps a-d.

The inventive method may also comprises the step of (f) compensating for the drag force in determining the normal force. The calculations in step (c) and/or step (d) include deformation equations based on Hertzian force deformation equations. The Hertzian-based force deformation equations include a condition that a ratio of a deformation caused by the impact to a radius of the golf ball is greater than about ⅓.

BRIEF DESCRIPTION OF THE DRAWINGS

In the accompanying drawing which forms a part of the specification and is to be read in conjunction therewith and in which like reference numerals are used to indicate like parts in the various views.

DETAILED DESCRIPTION OF THE INVENTION

Figure 1:
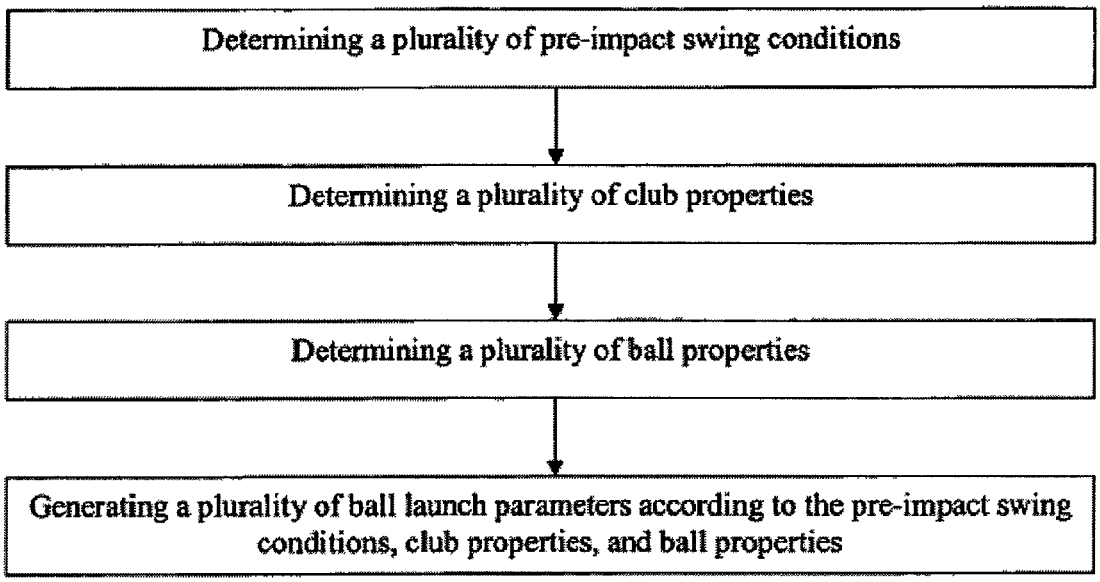
FIG. 1 is a flow chart showing exemplary steps according to one embodiment of the present invention.
Figure 2:
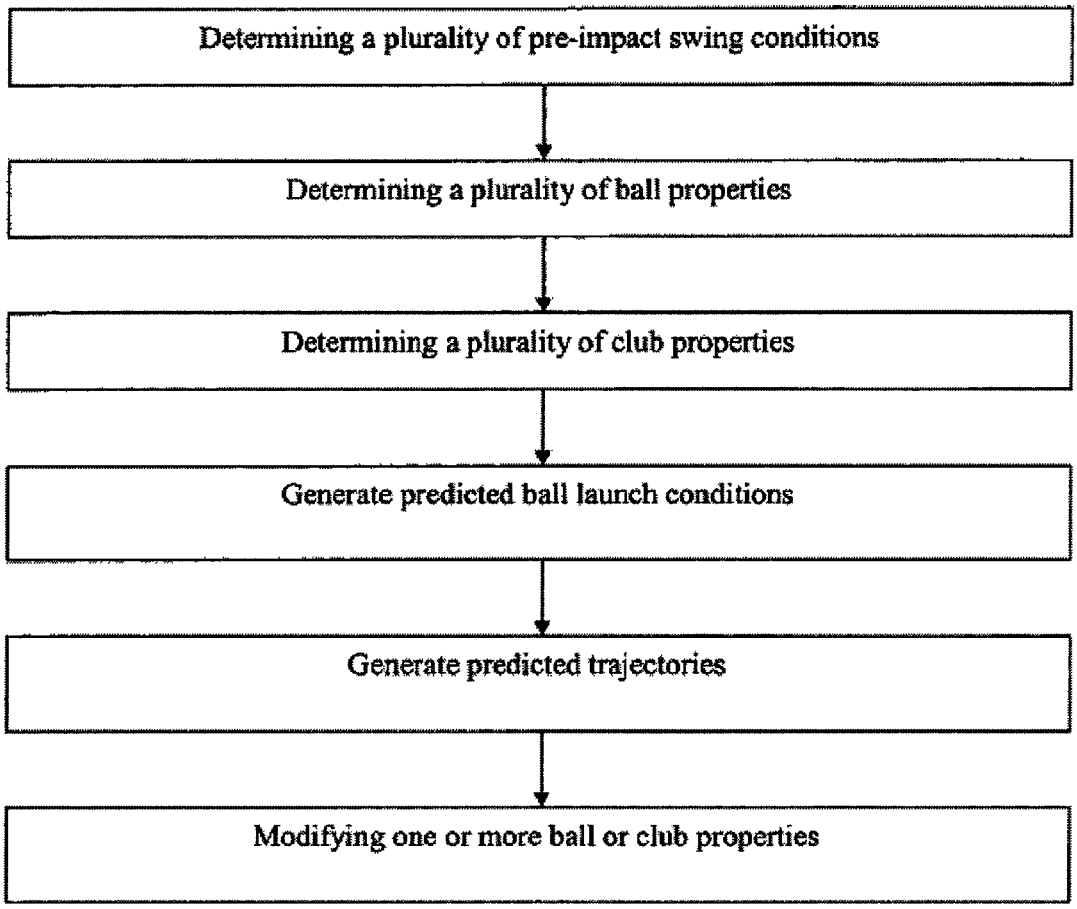
FIG. 2 is a flow showing exemplary steps according to another embodiment of the present invention.

The present invention relates to a method and computer program for predicting golf ball launch conditions, e.g., velocity, launch angle and spin rate. As shown in FIG. 1, by acquiring pre-impact swing conditions, e.g., club speed, rotational rate and ball hit location, along with pertinent club features, e.g., moment of inertia, and impact features, e.g., normal and transverse impact forces, as well as time of contact, an inventive method can predict the resulting trajectory and launch conditions of the golf ball. As shown in FIG. 2, the predicted ball launch conditions and trajectories can also be used to modify one or more properties of the golf ball or golf club. One advantage of the present invention is that the need for transducers to measure normal and transverse forces is eliminated, because such forces can be determined by measuring time of contact and coefficient of restitution. In yet another advantage of the present invention, the time of contact measurements are corrected to account for drag force.

As discussed in greater detail in the parent application, methods for predicting golf ball launch conditions and trajectories require a determination of a plurality of pre-impact swing properties, golf club properties, and golf ball properties. The present invention focuses on innovative process for determining impact properties, particularly the normal and transverse impact forces on a golf ball during collision and time of contact. When one combines such impact properties with golf club properties and pre-impact swing properties, one can utilize the methods depicted in FIG. 1 and FIG. 2.

In one aspect of the present invention, prediction and modeling tools have been developed to calculate the normal and transverse forces on a golf ball during collision with a slug, e.g. a golf club or steel block.

Heretofore, impact forces had to be measured, e.g., by pressure transducers or gages, such as strain gages, as discussed in US 2006/0272389. These sensors can sometimes produce unstable or inconsistent signals, especially when they are positioned off-center from the impact site. The present invention allows for the calculation of the normal and transverse forces from the amount of ball deformation, and the rate of ball deformation, i.e., the first derivative of the deformation as a function of time. A number of deformation theories can be used to translate the deformation of an elastic sphere during impact to the forces acting on the sphere. One such theory is the Hertzian force deformation theory, where the impact force (generally expressed as mass times acceleration) is generally expressed as:

$$F=-cx^{(3/2)},$$

where x is the ball deformation, and c is an elasticity factor.

See e.g. "Rigid Body Impact Models Partially Considering Deformation" by Polukoshko, S., Viba, J., Kononova. O. and Sokolova, S., published in the Proc. Estonian Acad. Sci. Eng., 2007, 13, 2, 140-155, which is incorporated herein by reference in its entirety. While the Hertzian model is being described and used hereafter, other mathematical models relating to impact forces and deformation and/or rate of deformation can also be used, such as the Kelvin-Voight medium model, the Bingham medium model, the viscoelastic Maxwell medium model and the Hunt-Grossley contact force model. (See Id.)

The normal and transverse impact forces can be used calculate golf ball launch conditions, e.g. velocity spin rate and launch angle. Given the complex nature of a golf ball's composition, the following approximations or modifications, when the deformation $\xi$ is greater than ⅓ of the radius "a" (or $\xi/a$ greater than ⅓), for Hertzian force deformation equations in the normal ($F_N$) and transverse ($F_T$) directions are as follows:

$$F_N = K_N\left(\frac{\xi_N}{\alpha}\right)^{3/2}\left(1 + A\left(\frac{\xi_N}{a}\right)^2\right)\left(1 + \alpha_N\frac{\dot{\xi}_N}{a}\right) \tag{1}$$

$$F_T = K_T\left(\frac{\xi_N}{\alpha}\right)^{1/2}\left(\frac{\xi_T}{a}\right)\left(1 + A\left(\frac{\xi_T}{a}\right)^2\right)\left(1 + \alpha_T\frac{\dot{\xi}_T}{a}\right) \tag{2}$$

where:

$K_N$ and $K_T$ are the normal and transverse force constants (see below), respectively;

$\xi_N$ and $\xi_T$ are the normal and transverse deformations of the golf ball, respectively;

$A_N$ and $A_T$ are the normal and transverse parameter to account for the fact that the stiffness constant K varies with the deformation;

a represents the radius of the ball; and $\alpha_N$ and $\alpha_T$ are the normal and transverse dampening constants to account for energy loss due to the nonresilience of the viscoelastic polymer used to make golf balls; $\alpha_N$ can be better represented by the expression $$\alpha_N = \alpha_1 + \frac{\alpha_2}{V_{normal}}$$

where $V_{normal}$ is the initial normal velocity of deformation. These a factors are discussed in parent application US 2007/0049393, previously incorporated by reference in its entirety.

As discussed in greater detail below, the parameters in the equations (1) and (2) may be calculated using experimental data about a golf ball. By way of example, and not limitation, the parameters of the normal force may be determined by measuring the coefficient of restitution and contact time at a measured series of impact velocities. The parameters of the transverse force may be determined, for example, by measuring the spin rate of different balls striking a lofted/angled steel block at a series of loft angles and speeds. These mechanisms for determining the force parameters are advantageous because they eschew the use of unstable force transducers, such as piezoelectric or foil strain gauges.

It should be further noted that equations (1) and (2) are modifications of the simple Hertz contact force law, when $\xi/a$ is much less than 1, given by the equation:

$$F = \frac{4}{3}\frac{E}{1-\nu^2}a^{1/2}\xi^{3/2} = K\left(\frac{\xi}{a}\right)^{3/2} \tag{3}$$

where:

$$K = \frac{4}{3}\frac{Ea^2}{1-\nu^2},$$

which can be described as a lumped force constant and is proportional to the Young's modulus of the rubber polymer of the golf ball and is inversely proportional to the Poisson's ratio, $\xi$=ball deformation, a=ball radius, E=Young's modulus, and v=Poisson's ratio.

As stated above, the simple Hertz law, given by equation (3), is valid for small deformations ($\xi/a \ll 1$), whereas the more complex Hertzian equations (1) and (2) account for departures from simple Hertz theory for larger deformations ($\xi/a > ⅓$).

The parameters for the normal force equation (1) can be determined from measurements of coefficient of restitution and time of contact. In order to fully appreciate how such data can be used to calculate normal force parameters, consider that if one applies Newton's second law to the collision of a slug with a golf ball then the following equations can be derived:

$$\ddot{x}_{ball} = \frac{F_N g}{W_{ball}} \tag{4}$$

$$\ddot{x}_{slug} = -\frac{F_N g}{W_{slug}} \tag{5}$$

In other words, acceleration is force divided by weight or mass of the ball or slug. In the golf ball/golf club impact, the acceleration of the deformation $\xi$ of the ball is the difference between the acceleration of the ball and the acceleration of the slug:

$$\ddot{\xi} = \ddot{x}_{slug} - \ddot{x}_{ball} = -F_N g\left(\frac{1}{W_{ball}} + \frac{1}{W_{slug}}\right) = -\frac{F_N g}{W_r} \tag{6}$$

$$W_r = \frac{W_{ball}W_{slug}}{(W_{ball} + W_{slug})} \tag{7}$$

Wr is commonly known as the resultant weight of the ball/slug or ball/club system. Applying the mathematical derivation taught by the Simon paper discussed above and by Goldsmith, W., *Impact: The Hertz Law of Contact: Chapter IV "Contact Phenomena in Elastic Bodies,"* pub. Edward Arnold, London (1960) pp. 88-91 and solving the above relative deformation equation (6), the following equation for contact time can be obtained using equation (8):

$$\text{contact time} = 3.2180\left(\frac{W_R^2 a^3}{g^2 K_N^2 V_0}\right)^{1/5}, \tag{8}$$

where $V_o$ is the initial relative speed, g is the gravitational constant of about 386 inch/second$^2$, and the other factors are described above.

The Goldsmith book is incorporated by reference herein in its entirety. Similarly, one can find the following solution for the coefficient of restitution ($C_R$) in closed form using equation (9):

$$\ln\left(\frac{1+\gamma}{1-\gamma C_R}\right) = \gamma(1 + C_R), \tag{9}$$

$$\text{where the constant } \gamma = \frac{\alpha_1 V_{normal}}{a} + \frac{\alpha_2}{a}$$

Given equations (8) and (9) above, one can determine the parameters of the normal force equation by measuring the coefficient of restitution and contact time at a measured series of impact velocities. More particularly, the parameters $K_N$ and $A_N$ can be determined from time of contact data, and the parameters $\alpha_1$ and $\alpha_2$ can be determined from coefficient of restitution data. The apparatus and method described in commonly held U.S. Pat. No. 6,571,600 to Bissonnette et al., which is incorporated herein by reference in its entirety, can be used to determine time of contact and coefficient of restitution.

In one example, the above differential equations for deformation can be solved with initial ball velocity and results in contact time and coefficient of restitution ($C_R$) as output. The parameters K, A and $\alpha_1$ and $\alpha_2$ in the force equations above are adjusted, e.g., by a nonlinear minimization search technique, until they agree with the experimental measurements of contact time and $C_R$. This methodology is preferably solved by computer software, such as Mathlab. The differential equations can be solved using the Runge-Kutta methods, including the Fourth-order Runge-Kutta method, the Explicit Runge-Kutta methods, the Adaptive Runge-Kutta method and/or the Implicit Runge-Kutta methods. Runge-Kutta methods are numerical iterative methods employed to arrive at approximate solutions of ordinary differential equations. These techniques were developed circa 1900 and are known to one of ordinary skill in the art. See e.g., Butcher, J. C., *Numerical Methods for Ordinary Differential Equations*, ISBN 0471967580, and *Mark's Standard Handbook for Mechanical Engineers,* 10$^{th}$ edition, edited by E. Avallone and T. Baumeister III, (1996), p. 2-39 ISBN 0-07-004997, which are incorporated herein by reference in their entireties.

Advantageously, the calculated $F_N$ and $F_T$ forces can be used by the methodology described in parent application US 2007/0049393, previously incorporated by reference above, to calculate the launch conditions of a golfer given his/her club kinematics, as shown in FIGS. 1 and 2, which are reproduced from US 2007/0049393.

Figure 3:
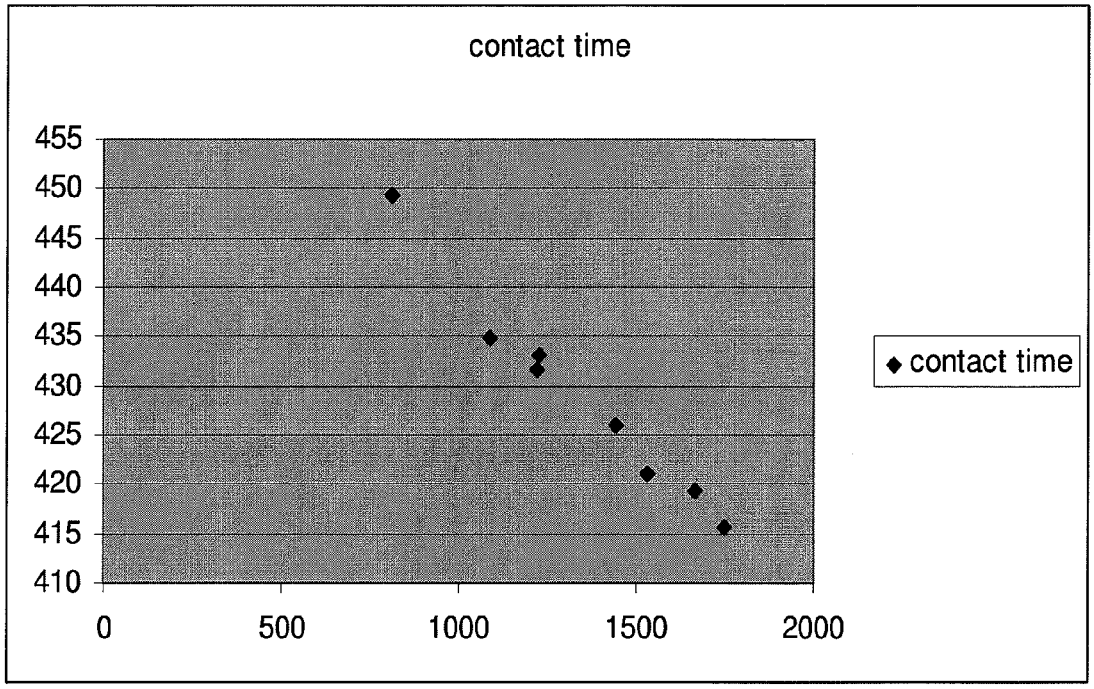
FIG. 3 is a chart plotting measured velocity versus coefficient of restitution.
Figure 4:
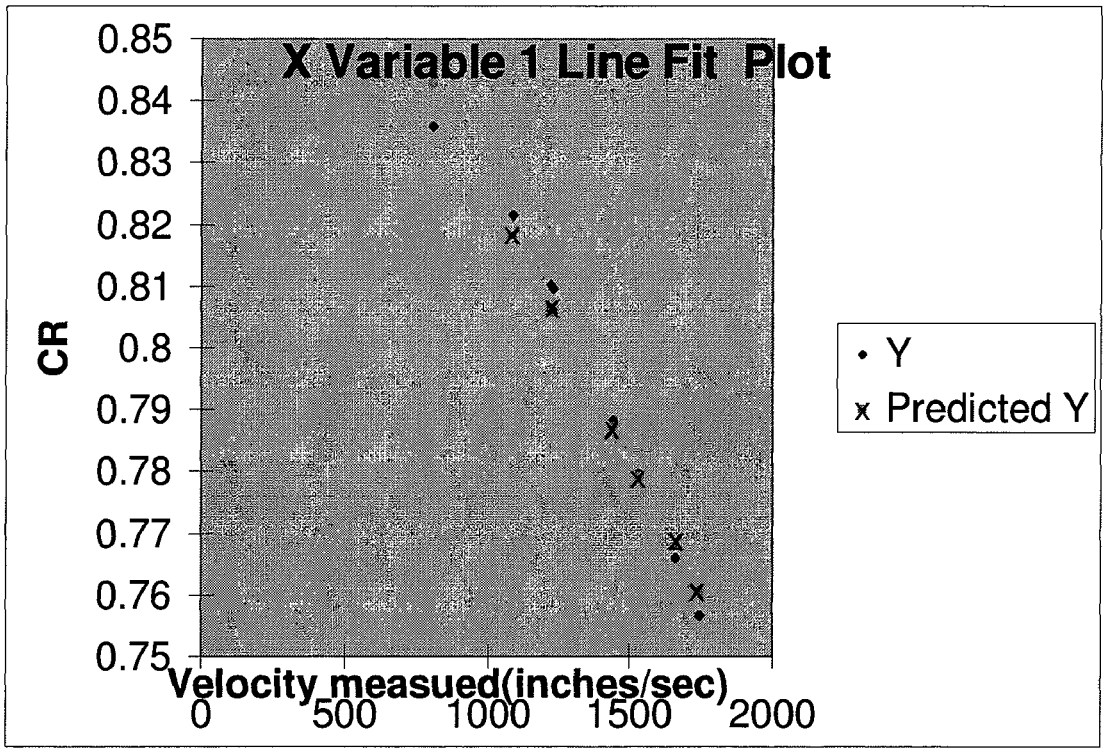
FIG. 4 is a chart plotting measured velocity versus time of contact.

FIG. 3 is a plot of measured impact velocity (in inches/second on the horizontal axis) for a Titanium Pinnacle® golf ball versus contact time (in microseconds on the vertical axis). FIG. 4 is a plot of measured impact velocity for the Titanium Pinnacle® golf ball versus coefficient of restitution or $C_R$. The plot also shows predicted $C_R$ data based on a line fit, which shows the utility of the present invention. FIG. 4 also shows that $C_R$ tends to decrease at higher initial velocity, since higher speeds lead to more energy loss, due to the fact that the visco-elastic material of the golf ball cannot response as quickly at higher strain rates. $C_R$ theoretically goes to 1 at 0 (zero) velocity.

Using a computer program to fit the contact time and coefficient restitution $C_R$ data, the following Table 1 lists normal force function parameters that were determined based on two time of contact values ($TC_1$ and $TC_2$) in microseconds and two coefficient of restitution values ($C_{R1}$ and $C_{R2}$):

TABLE 1

| Golf Ball | $K_N$ | $A_N$ | $\alpha_1$ | $\alpha_2$ | $C_{R1}$ | $C_{R2}$ | $TC_1$ | $TC_2$ |
|---|---|---|---|---|---|---|---|---|
| Pinnacle | 34015 | −.4 | 1.67e−04 | .1106 | .8359 | .7566 | 449 | 416 |

It is noted that since two unknown parameters ($K_N$ and $A_N$) have to be found for estimating contact time, at least two known contact times are used. Similarly, since two a parameters are needed, two measured $C_R$ are used.

When the normal force was plotted using the above parameters, a double hump function was found due to the negative constant $A_N$. Further, by plotting the log of contact time versus log of velocity, a slope of −0.1 rather than −0.2 was found for a Hertzian force. These calculations indicated that the normal force equation (1) should be modified to the following form:

$$F = K\left(\frac{\dot{\xi}}{a}\right)^{\beta}\left(1 + A\left(\frac{\xi}{a}\right)^2\right)\left(1 + \alpha\frac{\dot{\xi}}{a}\right) \tag{10.a}$$

where the exponent β ranges from about 1.2 to about 1.5. In one example, β is about 1.222, as shown in equation 10.b below.

$$F_N = K_N\left(\frac{\xi_N}{a}\right)^{1.222}\left(1 + A_N\left(\frac{\xi_N}{a}\right)^2\right)\left(1 + \alpha_N\frac{\dot{\xi}}{a}\right) \tag{10.b}$$

The parameters for modified equation (10) were determined from additional time of contact data and coefficient of restitution data, as show in the following Table 2. The data presented in Table 2 presents parameter values based on two tests performed on a ProV1® golf ball and two tests performed on a Pinnacle® golf ball, with one Pinnacle® test performed on a different machine.

TABLE 2

| Golf Ball | K | A | $\alpha_1$ | $\alpha_2$ | $C_{R1}$ | $C_{R2}$ | $TC_1$ | $TC_2$ |
|---|---|---|---|---|---|---|---|---|
| ProV1 (test 1) | 13185 | 4.0 | 1.60e−04 | .0781 | .861 | .771 | 494 | 426 |
| ProV1 (test 2) | 12919 | 5.0 | 1.36e−04 | .1232 | .847 | .770 | 500 | 427.5 |
| Pinnacle (test 1) | 17370 | .61 | 1.65e−04 | .1149 | .836 | .757 | 449 | 416 |

TABLE 2-continued

| Golf Ball | K | A | $\alpha_1$ | $\alpha_2$ | $C_{R1}$ | $C_{R2}$ | $TC_1$ | $TC_2$ |
|---|---|---|---|---|---|---|---|---|
| Pinnacle (test 2-different machine) | 16712 | 1.0 | 1.88e−04 | .0875 | .842 | .736 | 455 | 414.5 |

K, A, $\alpha_1$ and $\alpha_2$ are calculated and $C_{R1}$, $C_{R2}$, $TC_1$ and $TC_2$ are measured.

In yet another aspect of the present invention, one can determine the parameters of the transverse force equation (2) by measuring the spin rate of different balls striking a lofted steel block at a series of launch angles and speeds. As shown in the tables below, data on spin rate and launch angle were collected for a two piece ball hitting a 100 pound steel block with a smooth surface and a very rough surface at three incoming average slug velocities of about 530, 1280 and 1794 inches per second. The variations in the incoming velocities shown below reflect the minor variation in the pressure of the catapult used to fire the balls at the slug. The loft angles of the block varied from about 4°-60° at the various speeds. Also, VELBX and VELBY shown the Tables below represent the return velocities after hitting the block, as if the block were moving and the ball were stationary.

Data on the ball with impact with a smooth steel surface is shown below in Table 3:

TABLE 3

| VSLUG (IN/SEC) | VELBX | VELBY | SPIN (RPS) | LOFT (DEG) | LAUNCH ANGLE (DEG) |
|---|---|---|---|---|---|
| 521.5559 | 941.6064 | 61.9870 | 3.7899 | 4.5920 | 3.7664 |
| 532.5122 | 942.8799 | 151.7520 | 10.9846 | 10.4674 | 9.1431 |
| 531.7300 | 868.7710 | 269.1150 | 22.3790 | 20.6520 | 17.2112 |
| 530.8015 | 767.7590 | 354.4683 | 35.0658 | 30.3588 | 24.7824 |
| 534.1204 | 650.4038 | 396.6921 | 53.6806 | 40.1232 | 31.3797 |
| 531.5527 | 515.3569 | 388.7544 | 70.0700 | 49.7058 | 37.0287 |
| 1279.4082 | 2257.9177 | 126.4487 | 10.1805 | 4.5025 | 3.2054 |
| 1281.3389 | 2217.2051 | 339.5674 | 26.0598 | 10.6918 | 8.7073 |
| 1279.3218 | 2059.3828 | 623.3284 | 53.7567 | 20.5180 | 16.8399 |
| 1280.3359 | 1830.5535 | 814.9431 | 90.5763 | 30.8302 | 23.9981 |
| 1278.0732 | 1543.9656 | 903.4006 | 132.3741 | 39.3862 | 30.3326 |
| 1269.9238 | 1135.9087 | 972.6477 | 112.3131 | 49.6717 | 40.5726 |
| 1260.4951 | 759.0281 | 876.6440 | 106.7264 | 60.6320 | 49.1129 |
| 1791.2129 | 3089.6494 | 210.4102 | 16.6793 | 5.2972 | 3.8959 |
| 1799.8984 | 3049.4365 | 476.6213 | 37.7053 | 10.8210 | 8.8834 |
| 1794.9976 | 2834.0249 | 853.0210 | 74.6843 | 20.9686 | 16.7514 |
| 1793.6758 | 2514.6011 | 1117.5469 | 132.0922 | 30.8678 | 23.9615 |
| 1785.7864 | 2070.4512 | 1301.2810 | 154.4709 | 40.1880 | 32.1494 |

Data on the ball with impact with a rough surface is shown below in Table 4:

TABLE 4

| VSLUG (IN/SEC) | VELBX | VELBY | SPIN (RPS) | LOFT (DEG) | LAUNCH ANGLE (DEG) |
|---|---|---|---|---|---|
| 535.2368 | 961.0208 | 67.5150 | 5.1744 | 4.9840 | 4.0186 |
| 531.8115 | 935.4626 | 158.2061 | 11.8134 | 11.2372 | 9.5991 |
| 530.3159 | 857.7144 | 279.0923 | 21.8558 | 21.1530 | 18.0244 |
| 533.1362 | 757.2710 | 367.9802 | 31.4981 | 30.1693 | 25.9165 |
| 529.1833 | 619.9233 | 408.7327 | 40.1878 | 39.8775 | 33.3980 |
| 520.8284 | 469.2996 | 403.5603 | 48.0739 | 50.1837 | 40.6929 |
| 1297.0791 | 2304.1333 | 170.1636 | 12.0847 | 5.1062 | 4.2237 |
| 1293.6152 | 2242.9456 | 374.2007 | 27.1058 | 11.5127 | 9.4717 |
| 1292.8887 | 2064.3218 | 668.4875 | 50.0746 | 20.9917 | 17.9435 |
| 1288.6816 | 1792.6807 | 892.6125 | 71.8717 | 30.2625 | 26.4697 |
| 1299.3887 | 1507.6589 | 992.7534 | 96.4396 | 39.7275 | 33.3639 |
| 1280.6169 | 1184.5508 | 971.5530 | 126.0393 | 50.5130 | 39.3582 |
| 1793.8804 | 3097.3662 | 347.5066 | 23.8640 | 7.5366 | 6.4015 |

TABLE 4-continued

| VSLUG (IN/SEC) | VELBX | VELBY | SPIN (RPS) | LOFT (DEG) | LAUNCH ANGLE (DEG) |
|---|---|---|---|---|---|
| 1798.0247 | 3052.2920 | 511.8040 | 38.0111 | 11.4233 | 9.5187 |
| 1793.4854 | 2815.1680 | 915.4114 | 67.8287 | 20.9807 | 18.0130 |
| 1802.2520 | 2461.5984 | 1235.6895 | 95.4695 | 30.4155 | 26.6561 |
| 1793.8970 | 2050.2358 | 1362.5698 | 132.4809 | 40.3363 | 33.6077 |
| 1798.4453 | 1688.4316 | 1299.4424 | 202.1579 | 50.0582 | 37.5824 |

The smooth block data above was used to determine two transverse force equation (2) parameters, $K_T$ and $A_T$, as well as the coefficient of friction $CF_T$. The data were fitted to the square of the difference between the model backspin rate and the above measured spin rate. It should be noted that the coefficient of friction of friction $CF_T$ implicitly enters into transverse force equation (2) because if $F_T/IF_N$ exceeds $CF_T$ then the value of $\xi_T$ is reduced by slippage until $F_T/F_N=CF_T$. While $CF_T$ can be measured at high block angles where sliding prevails throughout impact, $CF_T$ is preferably used as an unknown parameter that can be adjusted to minimize the square of the total sum of the calculated spin rate to the measured spin rate at impact. When slippage occurs, the ball slides on the contact surface and cannot exceed the normal force times $CF_T$, as discussed in the parent patent application.

In other words, $$\begin{aligned} CF_T &= F_T / F_N, \\ &= K_T / K_N \cdot (\xi_T / \xi_N) \cdot (1 + A_T(\xi_T / a)^2) / (1 + A_N(\xi_N / a)^2). \end{aligned}$$

For a homogeneous, dimple-less ball, $K_T/K_N$ equals to shear modulus/Young's modulus, because $K_T$ is proportional to shear modulus, which is a deformation under torsion, and $K_N$ is related to compression or normal deformation. Also, $A_T$ is substantially the same as $A_N$ and $\alpha_T$ is substantially the same as $\alpha_N$.

Figure 5:
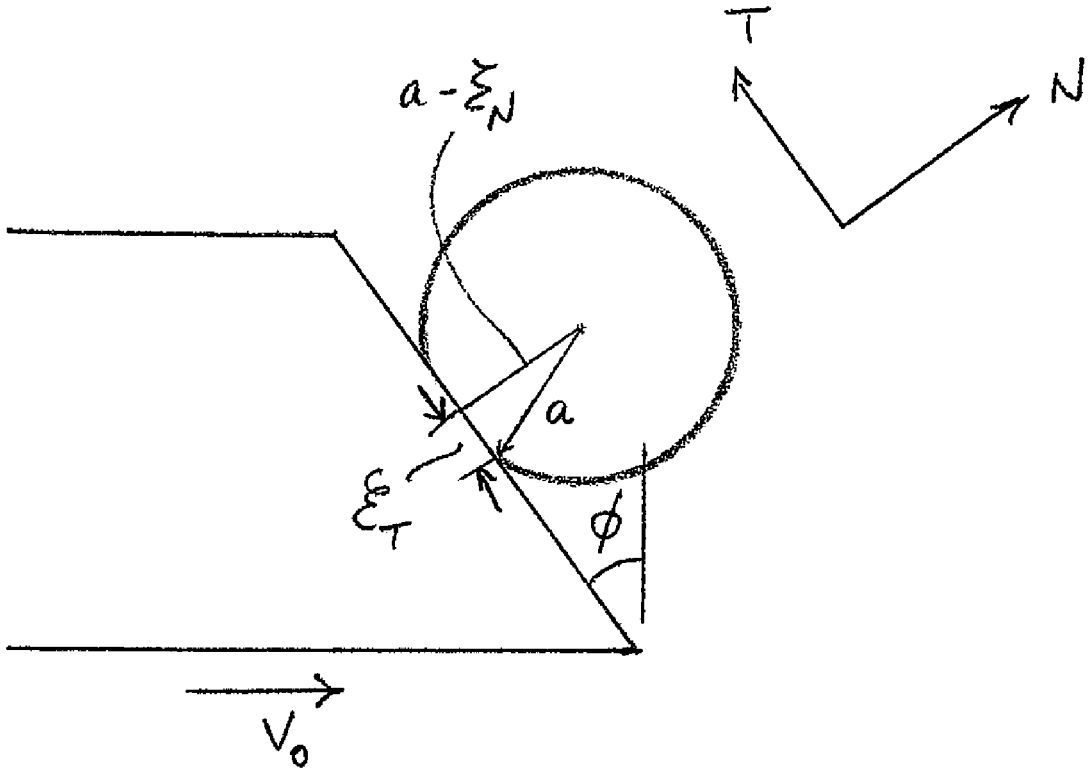
FIG. 5 is a schematic drawing of the golf ball impact model.

For a non-homogenous or composite golf ball, it is more challenging to anticipate impact conditions without experimentally determining the various factors discussed herein. A model for such impact is shown in FIG. 5. As shown, a short time, dt, has elapsed since impact between the ball and slug (club). The slug velocity is $(V_0 \cdot \cos \phi)$ in the normal or N direction and $(-V_0 \cdot \sin \phi)$ in the transverse or T direction. The transverse deformation of the ball $\xi_T$ is negative, because the center of the ball contact area is displaced down the incline with respect to the center of the ball.

Assuming no slippage or infinite $CF_T$, the transverse deformation is represented by $$\xi_T = -V_0 \cdot \sin \phi \cdot dt$$

and at time dt the center of the ball is essentially stationary. The normal deformation $\xi_N$ is positive until the ball separates from the slug. $\xi_N$ is the difference between the center of the ball and the position of the slug contact positioning the normal direction. All variable outputs can be adjusted to this time of contact.

The normal force $F_N$ in the ball is positive and produces an acceleration of the ball center in the $N^+$ direction as follows:

$$a_N = g \cdot F_N / W_{ball},$$

where $a_N$=acceleration in the normal direction g=gravity and $W_{ball}$=weight of ball.

The ball displacement produced by $a_N$ tends to reduce the increase in $\xi_N$ resulting from the forward motion of the slug (club). Eventually, the ball velocity in the normal direction exceeds the slug velocity in the normal direction, which indicates separation and the end of the impact.

The transverse force $F_T$ on the ball is negative and produces acceleration of the ball center in the $T^-$ direction down the impact plane as follows:

$$a_T = g \cdot F_T / W_{ball},$$

where $a_T$=acceleration in the transverse direction. The displacement from the double integration of this acceleration tends to reduce the magnitude of $\xi_T$.

The torque on the ball is given by $$L_z = -F_T \cdot (a - \xi_N) - F_N \cdot \xi_T,$$

which is positive counterclockwise about the Z-axis (outward from the plane of FIG. 5 and orthogonal to the N and T directions). Since $F_T$ is negative and $\xi_T$ is also negative, both contributions to the torque are positive. This torque produces an angular acceleration, $B_z$, of the ball given by $$B_z = g \cdot L_z / (0.4 W_{ball} \cdot a^2).$$

The contact area center is displaced up the incline from the resultant rolling of the ball thereby also tending to reduce the magnitude of $\xi_T$. The moment of inertia of the ball about the Z-axis is not changed significantly by the ball distortion from the undistorted value of $(0.4 W_{ball} \cdot a^2)$.

The ball tends to displace and roll in such a manner as to reduce the magnitudes of the two ball distortions, $\xi_N$ and $\xi_T$ produced by the slug motion. The eventual reduction of $\xi_N$ to zero determines when the ball leaves the club face.

In order to reduce the problem of comparing the time scales of the $\xi_N$ and $\xi_T$ changes, set $$F = K\left(\frac{\xi_N}{a}\right)^{3/2}$$

$$F = K_T \xi_N^{1/2} \xi_T / a^{3/2}$$

and assume $W_s$(slug weight)>>$W_{ball}$, so that the slug velocity remains essentially constant at $V_0$ throughout the ball contact period. Also neglect effects of ball distortion on the torque and simplify the torque equation to $$L_z = -F_T \cdot a.$$

The deformation equations become $$\begin{aligned}\ddot{\xi}_N &= -aN \\ &= -gK_N\left(\frac{\xi_N}{a}\right)^{3/2} \Big/ w_B \\ &= -gK_N\left(\frac{\xi_N^{1/2}}{a^{3/2}}\right)\frac{\xi_N}{W_B}\end{aligned}$$

$$\begin{aligned}\ddot{\xi}_T &= -a_T + a \cdot b_z \\ &= -gK_T\left(\frac{\xi_N}{a}\right)^{1/2}\left(\frac{\xi_T}{a}\right)(1 + 5/2)/W_B\end{aligned}$$

and $$\ddot{\xi}_T = -\left(\frac{3.5 g K_T \xi_N^{1/2}}{a^{3/2} W_B}\right)\xi_T$$

Both equations are written in the form of $\ddot{\xi} = -\omega^2 \xi$, i.e., the second derivative of deformation (acceleration of the deformation) is expressed in term of the square of angular velocity and the deformation. These differential equations are simple harmonic motion with angular frequency ω. Although the motions are only approximately simple harmonic since the expressions for ω are not constants but involve $\xi_N^{1/2}$, nevertheless the quantities in the parenthesizes determine the time scales for the oscillations. In other words, $\xi_T$ executes a half cycle (return to zero) in a shorter time than $\xi_N$ executes a half cycle by the factor $(K_N/3.5K_T)^{1/2}$. If $K_T = K_N$ this factor is $(1/3.5)^{1/2}$ or about 53.4%, i.e., in roughly half the time.

For the homogenous ball, $K_T < K_N$, so that the time factor would be closer to unity. For the heterogeneous ball, $K_T$ may be comparable in value to $K_N$, because of the transverse stiffness of the ball casing. Also for the heterogeneous ball, the moment of inertia may be less than or greater than $(0.4 W_{ball} \cdot a^2)$, depending upon whether the higher density materials are closer to the ball center or closer to the ball surface, respectively.

Test Data and Results

As explained above, the normal force equation (1) parameters, $K_N$, $A_N$, $\alpha_1$ and $\alpha_2$, can be determined from time of contact and coefficient of restitution data, which are measured with an impact block at zero loft angle. The model normal force and transverse force parameters are listed below in Table 5.

TABLE 5

| $K_N$ | $A_N$ | $\alpha_1$ | $\alpha_2$ | $K_T$ | $A_T$ | $CF_T$ |
|---|---|---|---|---|---|---|
| 20616 | 0 | .000123 | .221 | 54491 | 418.3 | .7545 |

Using the aforementioned model parameters with model equations (1) and (2), one can predict ball launch conditions, such as spin rate and launch angle, according to the method outlined in FIG. 1. In order to determine the accuracy of the present invention, the calculated spin rates and launch angles were compared with the measured spin rates and launch angles for a ball moving in a reference frame where the block is traveling at the speed of the incoming ball, as shown in Table 6 below.

TABLE 6

| Calculated spin(RPS) | Measured spin(RPS) | Calculated launch angle(degrees) | Measured launch angle(degrees) |
|---|---|---|---|
| 15.46072 | 16.67 | 4.891348 | 3.896 |
| 36.87314 | 37.7 | 9.772471 | 8.88 |
| 76.68364 | 74.7 | 18.4596 | 16.75 |
| 6.603236 | 3.7899 | 3.784505 | 3.766 |
| 12.92316 | 10.98 | 8.912037 | 9.14 |
| 19.46854 | 22.37 | 18.26719 | 17.2 |
| 11.37713 | 10.18 | 4.000382 | 3.2 |
| 26.78619 | 26.06 | 9.499393 | 8.7 |
| 51.99001 | 53.75 | 18.0355 | 16.8 |
| Average difference | −.218 | Average difference | −.81 |
| Standard deviation | 1.96 | Standard deviation | .59 |

From Table 6 above, it can be seen that over a launch angle range of 4-17 degrees, the spin rate can be fitted to 2 rps or 120 rpm. Further, the measured launch angle averaged only about a 0.6 degree error. These experimental data represent improvements over the conventional methods, because they demonstrate that only three model parameters, $K_T$, $A_T$ and $CF_T$, can be used to predict nine different test points, since $K_N$, $A_N$, $\alpha_1$ and $\alpha_2$ were determined by $C_R$ and contact time. The transverse force parameter $\alpha_T$ is set to zero and is not used to adjust the transverse force equation in this derivation.

The rough textured surface block data above was also used to determine two transverse force equation (2) parameters, $K_T$ and $A_T$, as well as the coefficient of friction $CF_T$. The data were fitted to the sum of the square of the spin rate calculated minus the measured spin rate weighted at each measurement point by the inverse of the measured spin rate. The normal force parameters remained the same as above. The model normal and transverse force parameters are listed below in Table 7:

TABLE 7

| $K_N$ | $A_N$ | $\alpha_1$ | $\alpha_2$ | $K_T$ | $A_T$ | $CF_T$ |
|---|---|---|---|---|---|---|
| 20616 | 0 | .000123 | .221 | 54203 | 486.5 | .676 |

As can be seen from the Table 8 below, model parameters derived from the rough textured surface block data were able to more accurately predict spin rates and launch angles, according to the method outlined in FIG. 1. Table 8 below presents the calculated and measured values as well as a percentage difference between the two values.

TABLE 8

| Calculated Spin | Measured spin | Difference | Calculated launch | Measured launch | Difference |
|---|---|---|---|---|---|
| 22.44527 | 23.86 | −1.41473 | 6.936162 | 6.4 | 0.536162 |
| 38.2734 | 38 | 0.273397 | 10.34241 | 9.52 | 0.822414 |
| 70.57179 | 67.8 | 2.771792 | 18.66796 | 18 | 0.667958 |
| 12.34529 | 12.08 | 0.265293 | 4.574827 | 4.22 | 0.354827 |
| 27.76196 | 27.106 | 0.655965 | 10.2969 | 9.472 | 0.824904 |
| 48.22795 | 50.1 | −1.87205 | 18.71143 | 17.94 | 0.771432 |
| | Avg spin diff. | 0.113279 | | Launch diff. | 0.662949 |
| | std | 1.654524 | | std | 0.186797 |

As can be seen from the data above, there is a very good fit between the model and measured values for an incoming slug velocity in the range of 1300-1800 inch/second and loft angles between 6°-20°. More particularly, using model parameters derived from the rough textured surface block data, the spin rate can be fitted to 1.65 rps or 99 rpm (as opposed to 2 rps or 120 rpm for model parameters derived from smooth block data), and the measured launch angle averaged only a 0.2 degree error (as opposed to a 0.6 degree error for model parameters derived from smooth block data).

EXAMPLE 1

Determining Constants of the Normal Force Equation $$F = K\left(\frac{\xi}{a}\right)^{3/2}\left(1 + A\left(\frac{\xi}{a}\right)^2\right)\left(1 + \alpha\frac{\dot{\xi}}{a}\right) \tag{1}$$

where $$\alpha = \alpha_1 + \frac{\alpha_2}{V_{normal}}$$

in which $V_{normal}$ is the initial velocity of relative impact.

1. find the damping constant $\alpha$ by solving $$\ddot{\xi} = -F(\xi)g\left(\frac{1}{W_{ball}} + \frac{1}{W_{slug}}\right)$$

based on an explicit Runge-Kutta formula and the Dormand-Prince pair. This process is a one-step solver, i.e., in computing $y(t_n)$, it needs only the solution at the immediately preceding time point, $y(t_{n-1})$. The solution of the above equation needs the initial speed of the ball into block/slug and an approximate estimate of K with A=0 since as shown earlier coefficient of restitution is independent of the constants, K, A that determine contact time. Knowing the returning speed from the block, the value of constant $\alpha$ using a Nelder-Mead Simplex method from a commercial software such as Mathlab.

2. Find the damping constant $\alpha$ at a second velocity measurement in the same manner as step 1.
3. Compute the constants $\alpha_1$ and $\alpha_2$ in $$\alpha = \alpha_1 + \frac{\alpha_2}{V_{normal}}$$

by solving this equation knowing $\alpha$ as calculated above in 1 and 2 at two speeds.

4. With the damping part of equation 1 found, the constants K and A can be determined by solving equation $$\ddot{\xi} = -F(\xi)g\left(\frac{1}{W_{ball}} + \frac{1}{W_{slug}}\right).$$

When the force in this equation goes to zero, the contact time is yielded. By measuring the contact time at two velocities, the constants K and A can be ascertained using the Nelder- Mead Simplex method. See Nelder, J. A., and Mead, R. 1965, Computer Journal, vol. 7, pp. 308-313.

EXAMPLE 2

Solving the Transverse Force Equation $$F_T = K_T\left(\frac{\xi_N}{a}\right)^{1/2}\left(\frac{\xi_T}{a}\right)\left(1 + A_T\left(\frac{\xi_T}{a}\right)^2\right)\left(1 + \alpha_T\frac{\dot{\xi}_T}{a}\right) \quad (2)$$

The transverse force is determined by three constants K, A and a damping constant $\alpha_T$. In this non-limiting example, set $\alpha_T=0$ to reduce the unknowns variables in the transverse force.

A coupled series of differential equations is solved using this force to arrive at the spin rate of a ball hitting a massive steel block. The resulting spin rate is a function of these three parameters and the coefficient of friction. As shown earlier, the normal force, $F_N$, is determined by the contact time and coefficient of restitution measurements. The initial conditions for the differential equations are as follows:

The slug velocity is V0 cos (ϕ) in the Normal direction to the block and −V0 sin(ϕ) in the transverse direction as discussed herein. Furthermore, $$\frac{d\xi_N(0)}{dt} = V_o\cos(\phi)$$

$$V_{SLUG}(0) = V_0$$

$$\frac{d\xi_T(0)}{dt} = -V_o\sin(\phi)$$

$$\omega_B(0) = 0$$

$$V_N^{BALL}(0) = 0$$

$$V_T^{BALL}(0) = 0$$

The initial normal and tangential velocity deformations above generate the following forces on the ball in the normal and tangential directions shown above in equations (1) and (2). These forces change the motion of the slug and the ball's spin and velocity while in contact as follows:

$$\frac{dV_N^{BALL}}{dt} = F_N g / W_{BALL}$$

$$\frac{dV_T^{BALL}}{dt} = F_T g / W_{BALL}$$

$$\frac{dV_{SLUG}}{dt} = -(F_N\cos(\phi) - F_T\sin(\phi))g / W_{SLUG}$$

$$\frac{d\omega_{BALL}}{dt} = -2.5g\Big/(aW_{BALL})\left[F_T\left(1 - \left(\frac{\xi_N}{a}\right)\right) + F_N\left(\frac{\xi_T}{a}\right)\right]$$

The ball deformation equations are as follows:

$$\frac{d\xi_N(t)}{dt} = V_{slug}\cos(\phi)V_{BALL}^N$$

$$\frac{d\xi_T(t)}{dt} = -V_{slug}\sin(\phi) - V_{BALL}^T + \omega\cdot(a - \xi_N)$$

where ω is the spin of the ball.

Using a predictor-corrector method to solve these differential equations, an initial time step of roughly 10 microseconds is taken since the duration of impact is about 400-500 microseconds. If the transverse force, $F_T$, is greater than $\mu*F_N$ (where μ is the coefficient of friction ($CF_T$) and $F_N$ the normal force) the slippage effect occurs. The slippage effect is a results of Coulomb's Law which states that the coefficient of friction times the normal force is less than or equal to the transverse force. This slippage effect requires that the slip increment be calculated by the following formula:

$$\text{slipt} = \text{slipt} - \xi_T\cdot\left(1 - \mu\frac{F_N}{|F_T|}\right)$$

to reduce the transverse deformation value, $\xi_T$, resulting in a lower absolute transverse force that is less than $\mu\cdot F_N$.

The first two steps in the integration of a new time step are done to check and compute the amount of slippage, if any. The next maximum of nine iteration steps is to be assured that the difference in the iterative calculation of the total force ($F_N$+$F_T$) between the predicted and calculated force has negligible difference before proceeding to the next time step. This indicates that the integration over this time step was successful. If after about ten iterations, a significant difference exist in the calculated and predicted force calculated then the time integration interval is cut in half so that the integration will improve in accuracy.

Completion of contact is noted when the previously calculated value of normal force is positive and the current value is negative. At that point, the a typical velocity component, V, can be calculated using $$V = (1 - fr)\cdot V_n + fr\cdot V_{np}$$

where $$fr = \frac{\xi_n}{\xi_n - \xi_{np}}$$

Once this calculation has been performed for a selected series of force constants A, K, and μ-friction coefficient the resulting value of spin rate calculated is compared with actual measurements at a series of block loft angles and ball input speeds. The sum of the difference squares between measured spin rate and calculated spin rate that is now a function of K, A, and μ is used as the function to minimize. The minimization algorithm found most useful is the downhill simplex method in accordance to a method taught by Nelder and Mead. See Nelder, J. A., and Mead, R. 1965, Computer Journal, vol. 7, pp. 308-313.

As discussed above, normal and transverse forces can be determined based, in part, on time of contact data. The time of contact data is also one of the variables used to predict golf ball launch properties and trajectories. However, conventional methods of measuring ball contact time, such as the method described in U.S. Pat. No. 6,571,600 to Bissonnette et al. (previously incorporated by reference in its entirety), do not correct for drag force. As discussed in the '600 patent, contact time can be measured using two light gates separated by three feet. The hitting block is approximately one foot from the second light gate. An assumption is made that the ball travels at a constant speed, $v_1$, in a direction normal to the striking surface and rebounds at constant velocity $v_2$. From a measurement of the four light gate times, $t_1$, $t_2$, $t_3$, $t_4$, the contact time can be calculated by the mathematical expression $(t_3-t_2)-Z/v_1(Z-D)/v_2$, where Z is the distance between the last gate and the hitting block and D the ball's diameter, as discussed in the '600 patent.

The importance of correcting for drag force has been discussed in a paper entitled "Experimental Determination of Apparent Contact Time in Normal Impact" by S. H. Johnson and B. B. Lieberman, pages 524-530, in *Science and Golf IV* edited by Eric Thain (2002), which is incorporated herein by reference in its entirety. Table 9 was created to show the effect of reduction in time of contact due to drag at incoming speed of 120 feet per second and exiting speed of 96 feet per second.

TABLE 9

| Drag coefficient (incoming) | Drag coefficient (outgoing) | Correction to contact time (microseconds) |
|---|---|---|
| .3 | .3 | −2.0 |
| .29 | .31 | −4.0 |
| .24 | .29 | −6.7 |
| .3 | .5 | −22 |

The Table above demonstrates that the drag effect can lead to a shorter contact and a higher calculated dynamic modulus. A shorter contact time indicates a stiffer or higher compression golf ball or stiffer modulus coefficient in the normal force.

Mathematical equations have been derived to calculate the coefficient of drag ($C_D$). Particularly, the following equation can be used to determine the effect of drag on contact time:

$$v_2 = v_1 \cdot \exp\left(-\frac{\rho A}{2m} C_D D\right) \tag{11}$$

In the above equation (11), $v_1$ is the velocity after passing the first gate, $v_2$ is the velocity after passing the second gate, D is the distance between the gates, ρ is air density (slugs/ft$^3$), A is the frontal area of the ball (ft$^2$), m is the mass of the ball (slugs), and $C_D$ is the coefficient of drag.

Assuming that measured average velocity, $v_a$, can be expressed by the formula $v_a=(v_1+v_2)/2$, then equation (1) can be used to estimate $v_2$ from $v_a$:

$$v_2 = 2 * v_a \cdot \exp\left(-\frac{\rho A}{2m} C_D D\right) \Big/ \left(1 + \exp\left(-\frac{\rho A}{2m} C_D D\right)\right) \tag{12}$$

From the above equation (12), one can determine that $C_D$=0.3 when $v_a$=120 fps, $v_1$=120.31 fps, and $v_2$=119.69 fps. More accurate time of contact values, in turn, can more accurately predict golf ball launch conditions and trajectories. All calculations were carried out at incoming speed of 120 feet per second and exiting speed of 96 feet per second.

One can also estimate the velocity, $v_3$, at the wall by means of the following equation:

$$v_3 = v_2 \cdot \exp\left(-\frac{\rho A}{2m} C_D D\right) \tag{13}$$

The time of flight to the wall is therefore $t_{in}=2D/(v_2+v_3)$ where D is the distance from the second light gate to the block.

On the rebound, the same calculations are repeated for finding the rebound velocity at the two gates from knowing the average measured velocity. The initial speed, $v_4$, leaving the block is given by the following equation:

$$v_4 = v_2 \cdot \exp\left(\frac{\rho A}{2m} C_D D\right) \tag{14}$$

where $v_2$ is the speed at the first return gate. The return time must be calculated by taking into account the ball diameter. Accordingly, the formula for the return time is given by the expression $t_{return}=2(D-d_{ball})/(v_4+v_2)$ in which $d_{ball}$ is the ball diameter, $v_4$ is the velocity leaving the block, and $v_2$ is the velocity calculated at the first rebound gate.

An exemplary method for estimating the corrected contact time to account for drag is as follows:

1. Determine speed of ball, $v_2$, leaving the two light gates by using Equation (12) at time $t_2$.
2. Determine speed, $v_3$, on hitting wall a distance D from second light screen using Equation (13).
3. Compute time of flight to wall where D is distance from wall to second light gate by using the following formula: Time in=$T_{in}=2D/(V_2+V_3)$.
4. On rebound from wall, the initial speed, $V_4$, leaving block is given from Equation (14), where $v_2$ is the speed at the first return light gate. The return time is $T_{RETURN}=2(D-\text{ball diameter})/(V_4+V_2)$.
5. The contact time is therefore $T_{CONTACT}$=time measured starting at the second light gate coming in and returning out through the same gate minus $(T_{in}+T_{RETURN})$.

It should be noted that equation (11), which allows one to correct contact time for drag, can be derived using the following steps. First, assuming that the x axis is in the horizontal direction and y axis is in the vertical direction, the two dimensional equations of motion of the ball are given by the following equations:

$$\dot{v}_x = \frac{\rho A}{2m}(v_x^2 + v_y^2)(-C_D\cos(\theta) - C_L\sin(\theta)) \tag{15}$$

$$\dot{v}_y = \frac{\rho A}{2m}(v_x^2 + v_y^2)(C_L\cos(\theta) - C_D\sin(\theta)) - g \tag{16}$$

where $$\theta = \tan^{-1}\left(\frac{v_y}{v_x}\right)$$

and $C_L$ is the lift coefficient. In a moving coordinate system where the t axis is the direction of the velocity of the ball, the equations of motion are given by the following equations:

$$\dot{v}_t = -\frac{\rho A}{2m} C_D v_t^2 - g\sin(\theta) \tag{17}$$

$$\theta v_t = \frac{\rho A}{2m} C_L v_t^2 - g\cos(\theta) \tag{18}$$

It should be noted that equation (17) represents the "tangential" force-acceleration of the ball, which is in the direction of motion. Equation (18) represents the force-acceleration of the ball that is normal or perpendicular to the path. Assuming that the ball has a small angle θ as a function of time, then the equation of motion in the tangential direction becomes $$\dot{v}_t = -\frac{\rho A}{2m} C_D v_t^2 \tag{19}$$

This assumption means that the velocity of the ball is affected only by drag and not by gravity. One solution of the approximate equation in the tangential direction is given by the expression $$v_t(t) = \frac{v_t(0)}{v_t(0)\frac{\rho A}{2m} C_D t + 1} \tag{20}$$

One can find a second solution to equation (19) by using the following identity:

$$\dot{v}_t = v_t \frac{dv_t}{dx} = -\frac{\rho A}{2m} C_D v_t^2 \tag{21}$$

By using the above identity (21) in equation (19), and integrating over the distance D between the light gates, one can arrive at equation (11) above.

Referring to FIGS. 1 and 2, the methods depicted therein may be performed using a computer program comprising computer instructions. The computer program, in part, would comprise the aforementioned mathematical tools to calculate normal and transverse forces as well as time of contact adjusted for drag. Any computer language, e.g. Visual Basic, or Fortran, and/or compiler may be used to create the computer program, as will be appreciated by those skilled in the art. Furthermore, the computer instructions may be executed using any computing device. The computing device preferably includes at least one of a processor, memory, display, input device, output device, and the like. Moreover, the computer instructions may be stored on any computer readable medium, e.g., a magnetic memory, read only memory (ROM), random access memory (RAM), disk, optical device, tape, or other analog or digital device known to those skilled in the art.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A method for predicting velocity, launch angle and/or spin rate of a golf ball following an impact with a golf club or a slug comprising the steps of a. determining at least one pre-impact swing conditions;

b. determining at least one property of the golf club;

c. calculating a normal force of the impact in a normal direction;

d. calculating a transverse force of the impact in a transverse direction; and e. predicting the velocity, launch angle and/or spin rate from steps a-d;

wherein the force deformation equation based on Hertzian force deformation equations for step (c) is $$F = K\left(\frac{\xi}{a}\right)^{\beta}\left(1 + A\left(\frac{\xi}{a}\right)^{2}\right)\left(1 + \alpha\frac{\dot{\xi}}{a}\right)$$

wherein ξ=ball deformation, a=ball radius and

β ranges from about 1.2 to about 1.5.

wherein, the ratio of (ξ) to a is greater than ⅓ and the dampening constant, α, is calculated using the following equation:

$$\alpha = \alpha_1 + \frac{\alpha_2}{V_{normal}}$$

wherein $V_{normal}$ is the initial velocity of relative impact.

2. The method of claim 1, wherein the force deformation equation for step (d) is $$F_T = K_T\left(\frac{\xi_N}{a}\right)^{1/2}\left(\frac{\xi_T}{a}\right)\left(1 + A_T\left(\frac{\xi_T}{a}\right)^{2}\right)\left(1 + \alpha_T\frac{\dot{\xi}_T}{a}\right)$$

wherein ξ=ball deformation, and a=ball radius.

3. The method of claim 2, wherein $F_T$ can be determined by measuring the spin rates of a plurality of golf balls striking the golf club or slug at different loft angle and velocity.

4. The method of claim 2, wherein a ratio of $F_T/F_N$ is directly related to the coefficient of friction of the impact.

5. The method of claim 1, wherein a coefficient of restitution of the impact is measured and the $\alpha_1$ and $\alpha_2$ factors are derived from the measured coefficient of restitution.

6. The method of claim 1, wherein a time of contact of the impact is measured and the K and A factors are derived from the measured time of contact and the time of contact is corrected for drag force.

7. The method of claim 1, wherein the loft angle of the club head or slug is between about 6° to about 20°.

8. The method of claim 1, wherein β is about 1.222.

* * * * *